US005380005A

United States Patent [19]

Hsu

[11] Patent Number: 5,380,005

[45] Date of Patent: Jan. 10, 1995

[54] IRON GOLF CLUB HEADS

[76] Inventor: Henry Y. C. Hsu, P.O. Box 1750, Taichung, Taiwan, Prov. at China

[21] Appl. No.: 243,580

[22] Filed: May 16, 1994

[51] Int. Cl.[6] ..... A63B 53/02

[52] U.S. Cl. ..... 273/80.8; 273/80.2; 273/174

[58] Field of Search ..... 273/80.1, 80.2, 80.3, 273/80.4, 80.5, 80.6, 80.7, 80.8, 80.9, 167 R, 167 K, 169, 171, 172, 173, 174, 167 A, 80 R, 77 R, 167 G, 80 C

[56] References Cited

U.S. PATENT DOCUMENTS

| | | | |
|---|---|---|---|
| 1,585,294 | 5/1926 | Link | 273/80.8 |
| 2,299,735 | 10/1942 | Birkhofer | 273/80.8 |
| 2,534,947 | 12/1950 | Bright | 273/80.8 |
| 3,640,534 | 2/1972 | Mills | 273/80.7 |
| 4,854,583 | 8/1989 | Kobayashi | 273/80.8 |
| 5,137,275 | 8/1992 | Nelson | 273/80.1 |
| 5,181,720 | 1/1993 | Stites | 273/80.8 |
| 5,205,553 | 4/1993 | Okumoto | 273/80.8 |
| 5,320,347 | 6/1994 | Parente | 273/80.2 |

FOREIGN PATENT DOCUMENTS

| | | | |
|---|---|---|---|
| 472373 | 3/1951 | Canada | 273/80.7 |
| 447320 | 5/1936 | United Kingdom | 273/80.8 |

OTHER PUBLICATIONS

"Golf World", Magazine, Jan. 26, 1973 issue, p. 23.
"Golf World", Magazine, Jun. 13, 1972 issue, p. 25.

*Primary Examiner*—Sebastiano Passaniti
*Attorney, Agent, or Firm*—Charles E. Baxley

[57] ABSTRACT

An iron golf club head has a hosel provided therein with a bore extending to reach the sole of the head. The striking blade of the head is provided at the rear end thereof with a tail seat extending to cover partially the bottom end of the bore. The hosel can be therefore shortened to an extent that the weight of the striking blade is increased and that the connection point of the shaft and the head is located at a level lower than the center of gravity of the striking blade, thereby resulting in an enhancement of the ball-striking effect of the head and in strengthening the fastening of the shaft with the head.

5 Claims, 4 Drawing Sheets

PRIOR ART

IRON GOLF CLUB HEADS

FIELD OF THE INVENTION

The present invention relates generally to a golf club head, and more particularly to an improved iron golf club head provided with means for achieving a better ball-striking effect and with means for joining the head securely to a golf club shaft.

BACKGROUND OF THE INVENTION

As shown in FIG. 1 of accompanying drawings, a conventional iron golf club of the prior art comprises mainly a head 1 and a shaft 10. The head 1 is provided with a striking blade 11 of an appropriate inclination. The head 1 is provided further at one end thereof with a hosel 12 having a bore 13 dimensioned to receive therein a lower end of the shaft 10. Such a prior art golf club has inherent shortcomings, which are expounded upon explicitly hereinafter.

The bore 13 of the hosel 12 of the prior art golf club head 1 has a closed bottom end. In order to facilitate fastening of the head 1 to the shaft 10, the hosel 12 is increased in length so that the depth of the bore 13 also can be increased. However, such an expedient of deepening the hosel 12 can bring about an adverse effect that the lengthened hosel 12 will reduce the ball-striking mass of the blade, and that the weight of the striking blade 11 therefore is so lessened as to undermine the ball-striking force of the striking blade 11.

As shown in FIG. 1, the bore 13 of the hosel 12 has a bottom end, which is designated as B and which must be higher than the center point A of the striking blade 11. As a result, upon hitting a golf ball, the head 1 is bound to generate the shock of a relatively greater magnitude while the bottom end of the shaft 10 is under a greater torsional stress. The ball-striking effect and the service life span of the golf club of the prior art therefore seriously undermined.

With a view to overcoming the shortcomings described above, a series of improved golf club heads are disclosed in U.S. Pat. Nos. 4,995,609; 5,067,711; 5,222,734; and 5,165,688. As illustrated in FIGS. 2 and 3, the above-mentioned disclosures comprise in common a head 1 having a hosel 12 which is provided with a bore 13 extending to reach the bottom portion of the head 1. In addition, the hosel 12 is shortened in length so as to increase the ball-striking mass of the striking blade 11 for better ball-striking effect. Furthermore, the bottom end B of the shaft 10 is relocated at a level lower than that of the center point A of the striking blade 11 for minimizing the shock generated by the head 1 upon hitting a golf ball and the torsional stress exerting on the shaft 10 at the time when the head 1 hits a golf ball.

The improved golf club heads disclosed in the above mentioned U.S. patents have inherent shortcomings, which are expounded explicitly hereinafter.

The bore 13 of the hosel 12 is extended through the bottom of the head 1. In order to prevent such "bore-through" design from undermining the structural strength of the striking blade 11 and to prevent the bottom end of the bore 13 and the bottom portion of the head 1 from forming an acute angle, the striking blade 11 of the head 1 is extended outwards for a distance. As shown in FIG. 6, the distance E between the center of the bore 13 and the rear line of the striking blade 11 is largely greater than the distance C of the prior art, and this will result in an uncomfortable feeling to the user when addressing, thereby requiring the user thereof to do more swinging practice so as to get accustomed to such a new golf club head as disclosed in the aforementioned U.S. patents.

As the bore 13 is extended through the bottom portion of the head 1, the shaft 10 cannot be located easily. In addition, the bottom end of the shaft 10 extends beyond the bottom portion of the head 1, as shown by the dotted line of FIG. 2. The extended portion of the bottom end of the shaft 10 must be removed by grinding, thereby resulting in waste of material and an increase in production cost. The extra portion of the bottom end of the shaft 10 may be removed before the shaft 10 is fastened with the head 1. However, such a practice is not feasible in view of the fact that the removal of the extra portion of the bottom end of the shaft 10 must be done with precision, and that the shaft 10 cannot easily be located in the bore 13.

When the golf club is used to strike a golf ball, the entire structure of the club is subjected to a tremendously large impact force. The shaft 10, disposed in the bore 13, after a period of use of the shaft 10, the adhering structure of the shaft 10 is bound to loosen to cause the shaft 10 to penetrate to destroy the matter. In addition, the material and the structural strength of the shaft 10 are different from those of the head 1. When the bottom of the shaft 10 is completely exposed through the bore 13 whose bottom end is not appropriately protected, the bottom of the shaft 10 is susceptible to damage caused by the collision and the abrasion between the club and the ground surface or other object when the shaft 10 is in the process of use, thereby affecting the effect of the use of the shaft 10.

SUMMARY OF THE INVENTION

The primary objective of the present invention is to order the head hosel to have therein a bore which is deepened to reach the bottom of the head. Furthermore, the rear end of striking blade of the head is extended to provide a tail seat located at the bottom of the bore, so as to cause the bottom of the bore to be half closed. By means of the structural improvement of the tail seat design in cooperation with the half-closed bore, the length of the head hosel is shortened to increase the weight of the striking blade and to order the combination portion of the shaft and the head to move to a place under the center of gravity of the striking blade in order to enhance the effect of the ball-striking impact force, and further to decrease the extent that the striking blade extends outwards by an added construction of the tail seat, and still further to improve the combination strength and convenience between the shaft and the head and the protection of the shaft from damage, etc. Therefore, the present invention overcomes the prior art structural shortcomings and meets the practicality appeal of invention and improvement.

The foregoing objective, features and functions of the present invention will be more readily understood by studying the following detailed description in conjunction with the accompanying drawings.

DETAILED DESCRIPTION OF THE INVENTION

Figure 1:
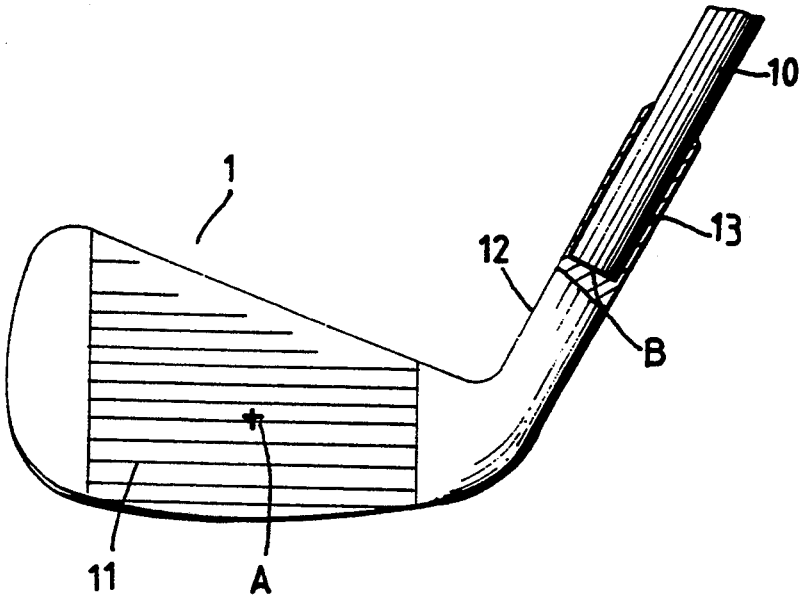
PRIOR ART FIG.1
FIG. 1. shows a partial sectional view of a golf club of the prior art.
Figure 2:
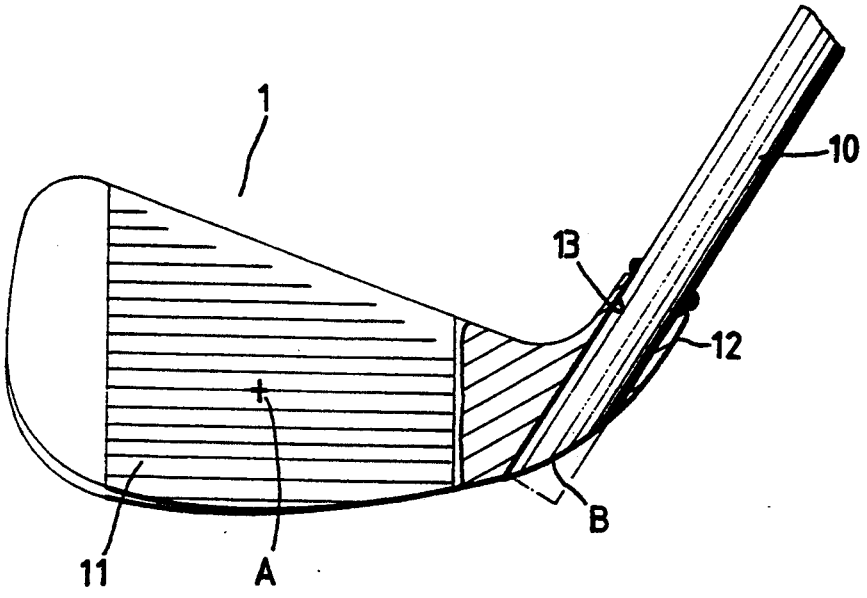
PRIOR ART FIG.2
FIG. 2 shows a partial sectional view of an improved golf club of the prior art.
Figure 3:
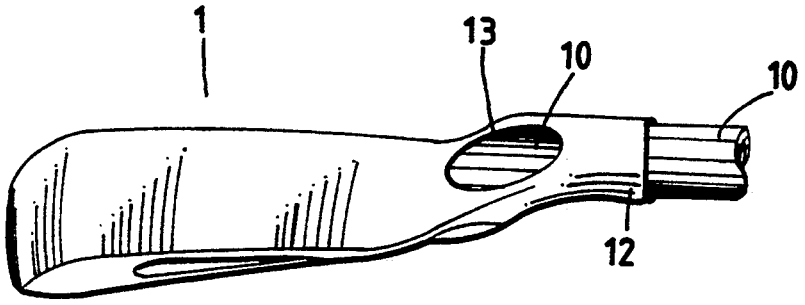
PRIOR ART FIG.3
FIG. 3 shows a bottom plan view of the improved golf club of the prior art.
Figure 5:
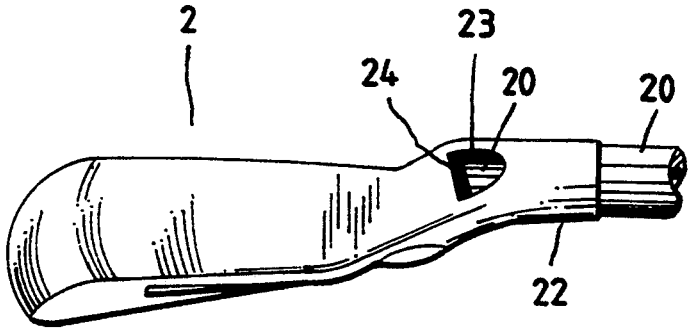
FIG. 5 shows a bottom plan view of the iron golf club of the present invention.
Figure 4:
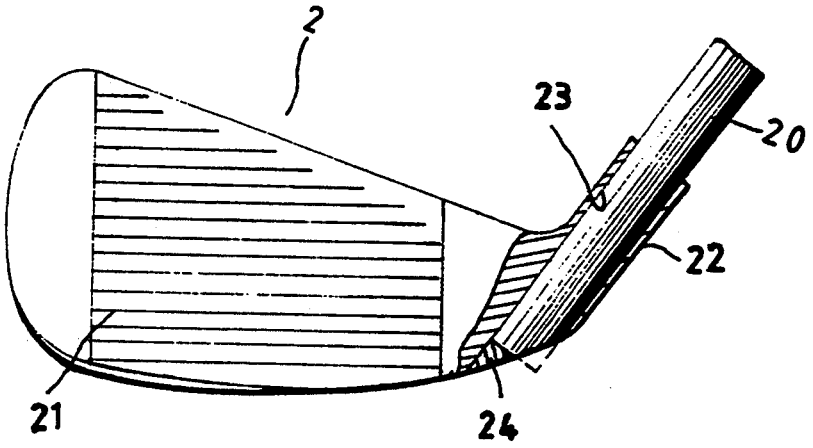
FIG. 4 shows a partial sectional view of an iron golf club of the present invention.

Referring to FIGS. 4 and 5, an iron golf club embodied in the present invention is shown comprising a head 2 and a shaft 20. The head 2 is provided on one side thereof with a striking blade 21 having an appropriate inclination. The head 2 is provided at one end thereof with a hosel 22 having therein a bore 23 with one end extending to reach the sole of the head 2.

The head 2 of the present invention is characterized in that it is provided with a tail seat 24 located at the bottom of the bore 23, as shown in FIG. 4 . As a result, the bottom end of the bore 23 is partially closed. The tail seat 24 is so disposed that it is connected with one side wall of the bore 23, and that the upper surface of the tail seat 24 is perpendicular to the wall of the bore 23, and further that the lower surface of the tail seat 24 is attached to the sole of the head 2. The bottom end of the shaft 20 is lodged in the bore 23 such that the front edge of the bottom end surface of the shaft 20 urges the upper surface of the tail seat 24, and that only a small portion of the rear edge of bottom and surface of the shaft 20 is located outside the bottom end of the bore 23, as shown by the dotted line in FIG. 4. Such a small extra portion of the shaft 20 can easily be removed by grinding. The size of the bottom area of the tail seat 24 is dependent on the radian of the sole of the head 2 and is corresponding to about $\frac{1}{4}$–$\frac{3}{4}$ of the bottom area of the bore 23. In other words, the size of the bottom area of the tail seat 24 is such that it can fully protect the naked bottom end portion of the shaft 20.

The length of the hosel 22 of the head 2 of the present invention is shortened to be slightly greater than one inch, preferably 1.5 inches. The hosel 22 may be either straight tubular in shape or tapered in shape. The hosel 22 of the head 2 can be shortened in length by virtue of the fact that the bottom end of the bore 23 is partially closed by the tail seat 24, thereby resulting in the transfer of the ball-striking mass of the hosel 22 to the striking blade 21. In addition, the fastening point between the head 2 and the shaft 20 is relocated at a level lower than the center of gravity of the striking blade 21 for enhancing the ball-striking effect of the head 2.

The advantages inherent in the present invention are readily apparent and are further expounded upon hereinafter.

Figure 6:
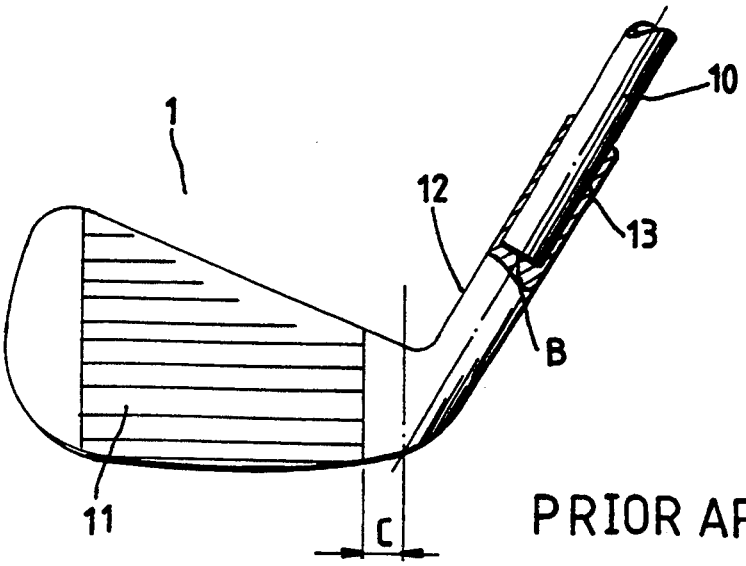
PRIOR ART FIG.6
FIG. 6 includes schematic views comparing the iron golf club of the present invention with that of the prior art.
Figure 6:
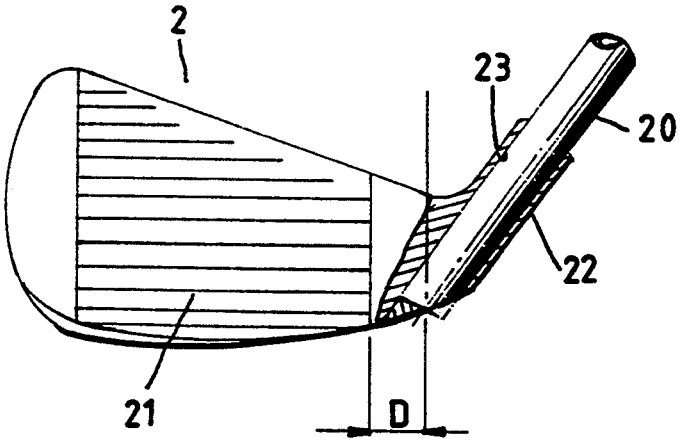
PRIOR ART FIG.6
Figure 6:
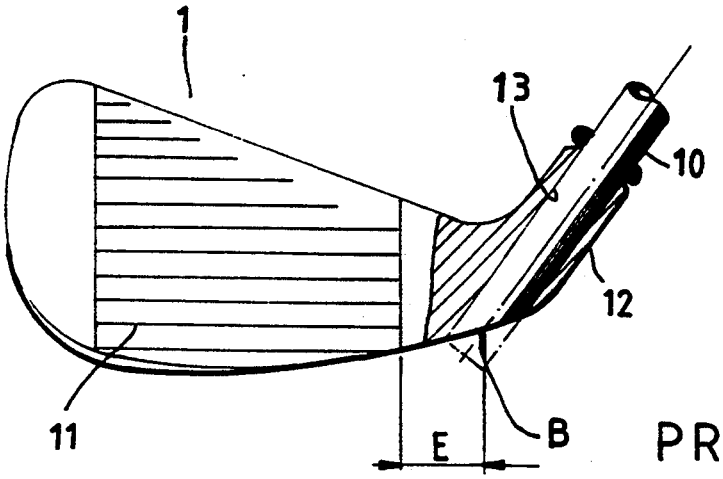
PRIOR ART FIG.6

In view of the structural design of the tail seat 24, the bottom of the head 2 is easy to withdraw and confine. Therefore, the striking blade 21 of the head 2 of the present invention needs to move forward and outwards for a short distance (please refer to FIG. 6, in which the distance D between the center of the shaft hole and the rear end line of the striking blade is slightly greater than the general distance C of the prior art club and is much smaller than the distance E of the outward movement required by the iron club having a through bore). Furthermore, in view of this minute outward movement of the ball-striking face, and as far as the eye vision length of the use of the iron club is concerned, it is just within the range of the naked eye observation difference. Therefore, as compared with the prior art iron golf club, the present invention does not produce a strange feeling or affect the use inertia. Therefore, the present invention is more practical than the prior art structure.

The head 2 and the shaft 20 of the present invention are fastened securely so as to ensure that the bottom end of the shaft 20 is not forced out of the sole of the head 2, thanks to the tail seat 24 which has the upper end surface supporting and locating the front edge of the bottom end of the shaft 20.

The bottom end of the shaft 20 of the present invention is protected by the partially closed bore 23. The bottom of the tail seat 24 of the present invention serves to close partially the bottom end of the bore 23.

The embodiment of the present invention described above is to be regarded in all respects as merely illustrative and not restrictive. Accordingly, the present invention may be embodied in other specific forms without deviating from the spirit thereof. The present invention is therefore to be limited only by the scope of the following appended claims.

What is claimed is:

1. An iron golf club comprising:

a head provided on one side thereof with a striking blade having an inclination, said head further provided at a neck end thereof with a hosel defining a bore, with one end of the bore extending to a sole of said head; and a shaft fastened to said head;

wherein said head is provided with a tail seat located at a heel portion of said head such that said tail seat partially peals off a bottom end of said bore of said hosel, said tail seat connected with an inner side wall of said bore, an upper end surface of said tail seat arranged laterally relative to the inner side wall, said upper end surface supporting and locating the bottom end of said shaft, a bottom end surface of said tail seat united with said sole.

2. The iron golf club of claim 1 wherein said tail seat has a bottom area corresponding to $\frac{1}{4}$–$\frac{3}{4}$ of a bottom area of said bore; and wherein said tail seat has a size dependent on a radian of said sole of said head.

3. The iron golf club of claim 1 wherein said hosel has a length between one and two inches; and wherein said bore is straight and tubular in shape.

4. The iron golf club of claim 3 wherein said hosel has a length of approximately one and one-half inches.

5. The iron golf club of claim 3 wherein said bore of said hosel is tapered in shape.

* * * * *